United States Patent [19]

Matsumoto

[11] Patent Number: 4,883,010

[45] Date of Patent: Nov. 28, 1989

[54] THREAD CHAIN CUTTING DEVICE

[75] Inventor: Takeshi Matsumoto, Osaka, Japan

[73] Assignee: Yamato Mishin Seizo Kabushiki Kaisha, Osaka, Japan

[21] Appl. No.: 194,263

[22] Filed: May 16, 1988

[51] Int. Cl.[4] ..... D05B 65/00

[52] U.S. Cl. ..... 112/288

[58] Field of Search ..... 112/288, 292, 294, 297, 112/301; 83/639

[56] References Cited

U.S. PATENT DOCUMENTS

| | | | |
|---|---|---|---|
| 3,250,237 | 5/1966 | Myiska | 112/288 |
| 3,696,770 | 10/1972 | Dunne et al. | 112/288 |
| 4,607,583 | 8/1986 | Biermann et al. | 112/288 X |
| 4,735,160 | 4/1988 | Hampel et al. | 112/288 |

*Primary Examiner*—Andrew M. Falik

*Attorney, Agent, or Firm*—Wenderoth, Lind & Ponack

[57] ABSTRACT

A thread chain cutting device has a lower knife which has an obtuse-angled edge fixed at the rear of a presser foot and an upper knife which is movable up and down and has a flat plane opposite to the obtuse-angled edge of the lower knife, whereby a thread chain is pressed and cut by the upper and lower knives.

1 Claim, 1 Drawing Sheet

THREAD CHAIN CUTTING DEVICE

BACKGROUND OF THE INVENTION

1. Field of the Invention

This invention relates to a device for cutting automatically continuous thread chains off the edge of a fabric sewn by a sewing machine which produces such thread chains such as a multi-needle a double chain stitch sewing machine or a flat seam stitch sewing machine. This device is relatively simple in construction and low in cost, but yet high in efficiency.

2. Prior Art

Conventionally, in cutting continuous thread chains off the edge of a fabric sewn by a multi-needle double chain stitch sewing machine or a flat seam stitch sewing machine, such thread chains are cut manually by scissors or cut automatically by a conventional thread chain cutting device which operates automatically. However, in the case of manual cutting, a complicated manipulation is involved and therefore skill and time are required for it and reduction in sewing efficiency is inevitable. In the case of the automatic thread chain cutting device, various complicated mechanical parts must be provided and consequently high manufacturing cost is required.

SUMMARY OF THE INVENTION

The present invention has for its object to provide an automatic thread chain cutting device which is simple in construction and low in cost, but yet high in efficiency. This device does not require such skill and time as in the case of manual cutting, nor require such complicated construction and subsequent high cost as in the case of a conventional automatic thread chain cutting device.

BRIEF DESCRIPTION OF THE DRAWING

The accompanying drawing shows a preferred embodiment of the present invention, in which.

DETAILED DESCRIPTION OF THE INVENTION

Figure 1:
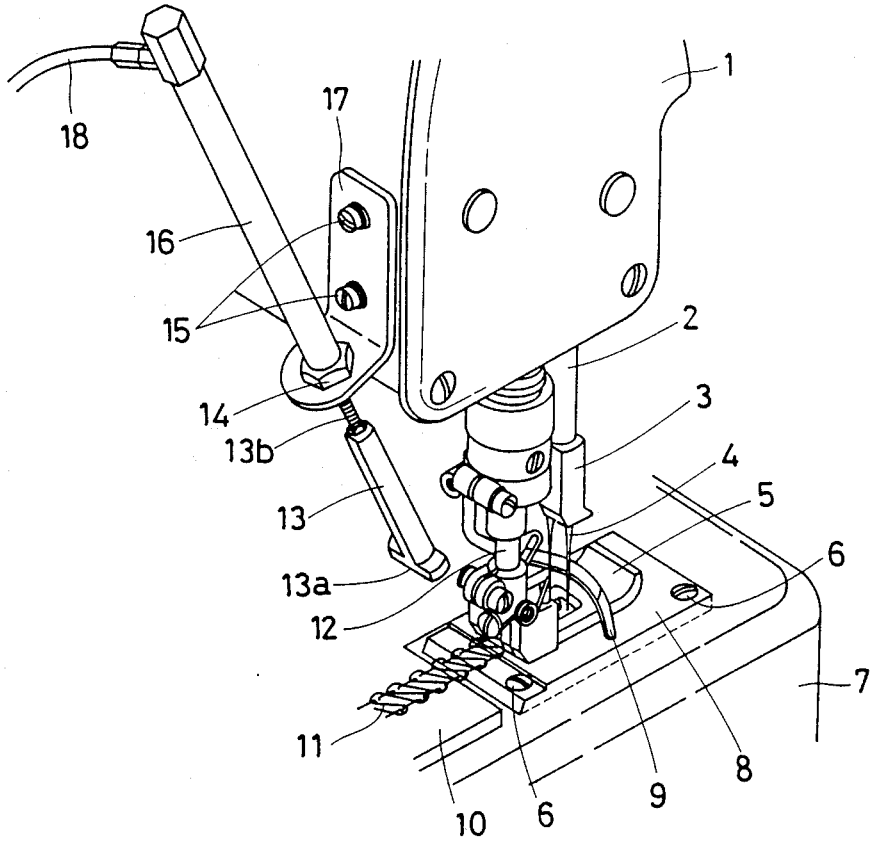
FIG. 1 is a perspective view of a main part of the automatic thread chain cutting device according to the present invention.
Figure 2:
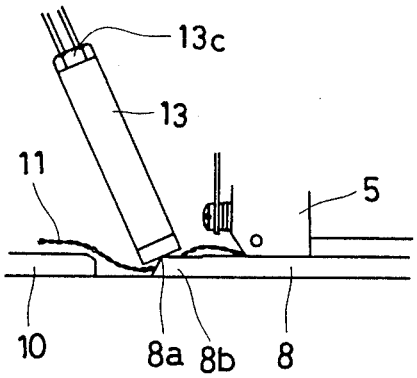
FIG. 2 is a side view, showing that an upper knife drops by the action of an air cylinder or a solenoid and cuts a thread chain.

A description is given below of a preferred embodiment of the present invention, with reference to the accompanying drawing.

Numeral 1 designates a machine arm fitted at the back thereof with a fixing plate 17 for an air cylinder 16 for driving an upper knife. Numeral 2 designates a needle bar with a needle clamp 3 screwed to the lower end thereof. A plurality of needles 4 are clamped by the needle clamp. Numerals 5, 6 and 7 designate respectively a presser foot, a set screw for a throat plate and a machine head. Numeral 8 designates a throat plate, a rear end of which is formed into a lower knife **8*b* with a corner having an obtuse angle 8*a*. Numeral 9 designates a top spreader. Numeral 10 designates a cloth plate slide cover. Numeral 11 designates a thread chain which is formed continuously at the edge of a fabric between consecutive fabric workpieces. Numeral 12 designates a presser bar with the presser foot 5 fitted at the lower end thereof. Numeral 13 designates an upper knife with a flat plane 13*a* at the bottom end thereof which is mounted movably up and down on the air cylinder 16 of the driving mechanism for elevating the upper knife. Numeral 13*b* designates a piston of the cylinder 16 and which is screwed into the upper knife 13 and fixes it with a nut 13*c*. The upper knife can be adjusted to an upper, lower or inclined position by loosening the nut 13*c* and then turning the upper knife 13. Numerals 14, 15, 16 and 17 designate respectively a fixing nut for the air cylinder, a set screw 9 for a fixing plate of the driving mechanism for elevating upper knife 13, an air cylinder for the driving mechanism for elevating upper knife 13 and a fixing plate for the air cylinder 16. Numeral 18 designates an air tube which supplies air for driving the air cylinder 16. In the case where a solenoid is utilized, instead of the air cylinder as a driving mechanism of elevating upper knife, the upper air tube 18 is replaced with a power cord. In this embodiment, the lower knife 8*b* is formed by making the rear end portion of the throat plate 8** at an obtuse angle to its horizontal surface. It is also possible to provide a separate a block-like piece at the rear end portion of the throat plate and form it into a lower knife having an obtuse angle shape. As the thread chain cutting surface of the upper knife is a flat surface and the lower knife has a cutting edge with an obtuse angle, while the cutting action is sufficient to cut the thread chain when the upper blade is drawn against the lower blade by the air cylinder or a solenoid, even if it so happened that a fabric was below the upper knife and the upper knife dropped, there is no such risks as cutting the fabric, injuring the operator's finger tip, etc. by the engagement of the flat face of the upper knife with the fabric, operator's finger, etc. and forcing it against the obtuse angle blade. In operating a solenoid or a cylinder, a switch, a valve or the like can be operated manually or can be operated automatically by utilizing known art.

What is claimed is:

1. A thread chain cutting device for use in a sewing machine which produces a thread chain, comprising:

an upper knife having a bottom surface in the shape of a flat plane;

a machine arm having a driving mechanism on which said upper knife is mounted for movement up and down in a direction substantially transverse to said flat plane, said driving mechanism being operable elevating and lowering said upper knife; and a lower knife having an obtuse angled cutting edge and being fixed in position beneath said upper knife for having said bottom surface of said upper knife engage said cutting edge during the lowering of said upper knife, whereby if said driving mechanism is accidentally actuated while fabric or an operators finger or the like is beneath said upper knife, there is no risk of cutting the fabric or the operator's finger.

* * * * *